US007311573B1

(12) United States Patent
Dillenschneider

(10) Patent No.: US 7,311,573 B1
(45) Date of Patent: Dec. 25, 2007

(54) WATER CRAFT PADDLE DEVICE FOR ONE-ARM USE

(76) Inventor: Cindy Dillenschneider, 79270 State Highway 13, Washburn, WI (US) 54891

( * ) Notice: Subject to any disclaimer, the term of this patent is extended or adjusted under 35 U.S.C. 154(b) by 0 days.

(21) Appl. No.: 11/529,194

(22) Filed: Sep. 27, 2006

(51) Int. Cl.
*B63H 16/04* (2006.01)
*B63H 16/00* (2006.01)
*A63B 31/00* (2006.01)

(52) U.S. Cl. ..... 440/101; 440/104; 441/55

(58) Field of Classification Search ..... 440/101, 440/104; 114/147, 343; 441/55–59
See application file for complete search history.

(56) References Cited

U.S. PATENT DOCUMENTS

| | | | | |
|---|---|---|---|---|
| 356,846 | A * | 2/1887 | Martin | 440/104 |
| 545,706 | A * | 9/1895 | Mannes | 416/63 |
| 2,188,343 | A * | 1/1940 | Flournoy | 416/63 |
| 3,039,120 | A | 6/1962 | Dowell et al. | |
| 3,109,184 | A * | 11/1963 | Moore, Jr. | 416/63 |
| 3,518,024 | A | 6/1970 | Wilson | |
| 4,233,925 | A | 11/1980 | Proctor | |
| 4,493,663 | A | 1/1985 | Richmond | |
| 5,062,816 | A | 11/1991 | Berglund et al. | |
| 5,795,201 | A | 8/1998 | Tibbetts | |
| 5,832,563 | A | 11/1998 | Simpson | |
| 6,042,438 | A * | 3/2000 | Dean | 440/101 |
| 6,264,519 | B1 * | 7/2001 | Brown | 441/55 |
| 6,709,306 | B2 * | 3/2004 | Brown | 441/56 |

* cited by examiner

*Primary Examiner*—Lars A. Olson
*Assistant Examiner*—Daniel V. Venne

(57) ABSTRACT

A water craft or canoe paddle device is provided for one-arm use. The paddle device enables a user to produce power strokes similar to strokes that are achieved with a traditional canoe paddle used by an individual using two unimpaired arms and two unimpaired hands. In one embodiment, one end of the paddle device for one-arm use is fastened to the upper torso, or shoulder area of the user. In a second embodiment, one end of the paddle device for one-arm use is fastened to the biceps area of the user. The design of the paddle shaft enables a user with one unimpaired arm to grasp the shaft of the paddle with their one unimpaired hand in substantially a perpendicular configuration to the shaft of the paddle. The power is achieved because the canoe paddle device for one-arm use design enables the large muscle groups of the shoulder, torso, back, and abdominal muscles to be utilized during each stroke of the paddle.

20 Claims, 7 Drawing Sheets

WATER CRAFT PADDLE DEVICE FOR ONE-ARM USE

CROSS REFERENCE TO RELATED APPLICATIONS

Not Applicable

FEDERALLY SPONSORED RESEARCH

Not Applicable

SEQUENCE LISTING

Not Applicable

FIELD OF THE INVENTION

This invention relates generally to the field of devices that assist people with physical disabilities to achieve superior results in spite of their physical disability. The instant invention generally relates to sports devices that aid individuals having physical disabilities to participate in sports activities in a superior fashion in spite of their physical disability. This invention more specifically relates to a water craft or canoe paddle device that is designed to be utilized by an individual that has use of only one arm.

DESCRIPTION OF PRIOR ART

There are several different designs for paddles that enable a user to propel a canoe or boat with that paddle using one arm and/or one hand.

U.S. Pat. No. 3,039,120—L Powell et al. discloses a One Handed Oar For Fishermen having a blade and a short handle that has a forearm brace and two openings that form a hand grip area that enables a user to grasp the paddle.

U.S. Pat. No. 3,518,024—P. M. Wilson discloses a one arm Boat Sculling Paddle having a blade and a short handle that has an upper end that is widened and flattened. The flattened end of the paddle has a hook shaped brace that retains the forearm of a user. The blade has a hole therethrough which enables a finger of the user to extend therethrough.

U.S. Pat. No. 4,233,925—Proctor—discloses a Paddle For Boats that has a blade portion, a hand grip portion and a wrist engagement portion that engages the wrist of a user.

U.S. Pat. No. 4,493,663—Richmond—discloses a One-Arm Paddle having a blade portion, a hand grip portion, and an arm brace portion that grips the forearm of a user.

U.S. Pat. No. 5,062,816—Berglund et al. Discloses an Aquatic Sporting Device designed for use with one-arm that is formed of three removable attached sections including a forearm brace, and an elongated longitudinal shaft between the blade and the brace.

U.S. Pat. No. 5,795,201—Tibbetts—discloses a one-handed Canoe Paddle that has a blade portion, a hand grip portion, and a U-shaped arm cuff portion that fits around the forearm of a user.

U.S. Pat. No. 5,832,563—Ronald Keith Simpson—discloses a Forearm Assist Device that has a frame that encircles at least part of a forearm of a user. The device also has a hand grip that can be grasped by the hand of a user. One end of the device has an attaching-detaching device that enables various different tools such as a crutch leg or a kayak paddle to be held by the Forearm Assist Device.

These paddles for one-arm use do not enable a one-arm user to produce a power stroke that a traditional canoe paddle provides when used by a user with two unimpaired arms and two unimpaired hands. These paddles are limited to small inefficient strokes that are useful for moving a canoe or a boat short distances or repositioning a boat or canoe in the water. These paddles extend in an axial direction parallel to a user's arm. The muscles utilized with these paddles are limited to the forearm and upper arm muscles of a user.

SUMMARY OF THE INVENTION

This invention, water craft or canoe paddle device for one-arm use, enables a user to produce power strokes similar to strokes that are achieved with a traditional canoe paddle used by an individual using two unimpaired arms and two unimpaired hands. One end of the canoe paddle device for one-arm use is fastened to the upper torso, or shoulder area of the user. The design of the paddle shaft enables a user with one unimpaired arm to grasp the shaft of the paddle with their one unimpaired hand in substantially a perpendicular configuration to the shaft of the paddle. The power is achieved because the canoe paddle device for one-arm use design enables the large muscle groups of the shoulder, torso, back, and abdominal muscles to be utilized during each stroke of the paddle. The canoe paddle device enables a person with the use of one arm to paddle a canoe with substantially the same power and efficiency that a person with two unimpaired arms and two unimpaired hands achieves when that person utilizes a conventional canoe paddle.

The discussion of the instant invention at times refers to the invention as a canoe paddle device, however it should be understood that the paddle device can be utilized in conjunction with any type of water craft.

OBJECTS OF THE INVENTION

It is an object of the invention to provide a canoe paddle device for one-arm use that enables a person with one functional arm to paddle a canoe with substantially the same power and efficiency that a person with two unimpaired arms and two unimpaired hands achieves when that person utilizes a conventional canoe paddle.

It is an object of the invention to provide a canoe paddle device for one-arm use which does not restrict the range of motion of the of the paddle thereby enabling greater stroke diversity.

It is another object of the invention to provide a canoe paddle device for one-arm use which can easily be adjusted so that the canoe paddle device can be fitted to a left arm or a right arm of a user.

It is another object of the invention to provide a canoe paddle device for one-arm use which can easily be adjusted so that the canoe paddle device can be fitted to different size users.

It is another object of the invention to provide a canoe paddle device for one-arm use which allows strokes to be employed with a high level of technical proficiency.

It is another object of the invention to provide a canoe paddle device for one-arm use which allows blade entry into the water within 10 degrees of the perpendicular or less to the surface of the water.

It is another object of the invention to provide a canoe paddle device for one-arm use which is manufactured of rugged light weight materials.

It is another object of the invention to provide a canoe paddle device for one-arm use where blade orientation accomplishes a perpendicular blade orientation to the keel line of the boat during propulsion strokes thereby providing a very efficient use of each paddle stroke.

It is another object of the invention to provide a canoe paddle device for one-arm use which can be a custom manufactured design for a particular individual.

It is another object of the invention to provide a canoe paddle device for one-arm use that enables the canoe paddle device to be easily released and also enables the canoe paddle device to be easily recovered.

It is another object of the invention to provide a canoe paddle device for one-arm use which can be manufactured in several detachable components. This would allow the canoe paddle device for one-arm use to be packed in a travel case that would not take up much space during travel.

It is another object of the invention to provide a canoe paddle device for one-arm use which enables the canoe paddle device to be easily attached and detached by use of one arm only.

It is another object of the invention to provide a canoe paddle device for one-arm use wherein the shaft and blade can be manufactured in substantially one continuous piece if so desired.

It is another object of the invention to provide a canoe paddle device for one-arm use which also allows unrestricted use of a personal flotation device, or a wetsuit, or clothing, etc.

It is another object of the invention to provide a canoe paddle device for one-arm use which has a bend in the shaft section that enables a user to grasp the paddle shaft section with one hand in a substantially perpendicular orientation to the paddle shaft. This perpendicular grasping orientation is a similar manner that a traditional two handed canoe paddle would be grasped by a user having two arms and two hands. This enables power strokes to be achieved.

BRIEF DESCRIPTION OF THE DRAWINGS

In order that the manner in which the above and other objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying annexed drawings wherein.

Figure 1:
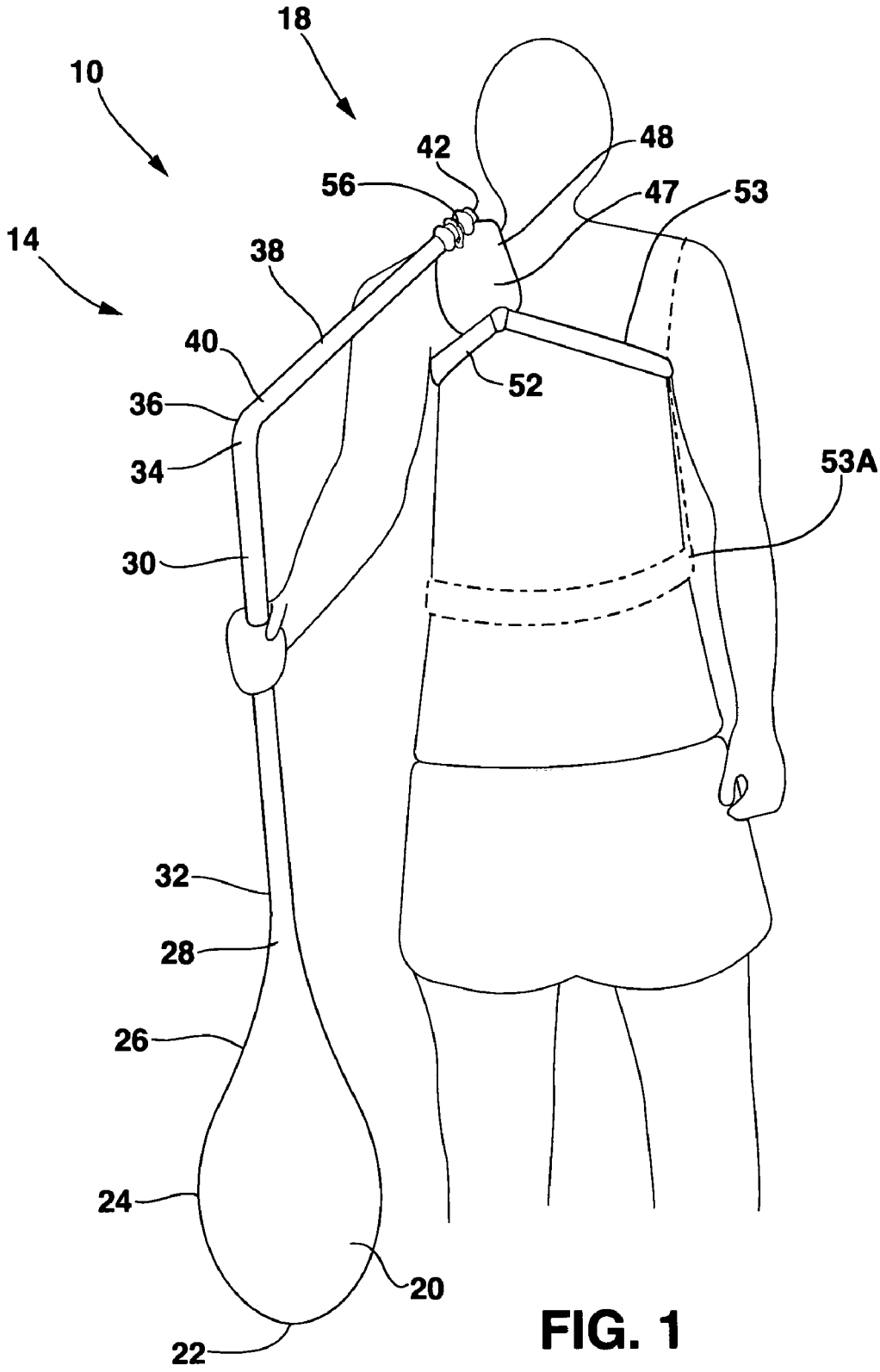
FIG. 1 is a front perspective view of one embodiment of the canoe paddle device for one-arm use designed for a right handed user.

The objects and advantages of the invention will become apparent when the drawings are studied in conjunction with reading the following description and also reading the claims.

DESCRIPTION OF THE PREFERRED EMBODIMENTS

In keeping with the requirements of Patent Laws there is described herein below the best mode of the invention that is currently known to the applicant. For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference now to the drawings, and in particular, to FIGS. 1-14 thereof, the preferred embodiments of the new and improved canoe paddle device for one-armed use embodying the principles and concepts of the present invention and generally designated by the reference number 10 will be described.

FIG. 1 shown generally at 10 a canoe paddle device for one-arm use having a blade and shaft section shown generally at 14 and a shoulder harness assembly shown generally at 18. Blade and shaft section has a blade 20 with the contoured tip 22 of the blade and wide section 24 of the blade and a curving section 26 that terminates in substantially a shaft 28. Paddle shaft section 30 has a blade end 32 and a non-blade end 34. Paddle shaft section 30 is grasped by a hand of a user and the hand and arm of a user is substantially in a perpendicular orientation to the axis of paddle shaft section Paddle shaft end 34 transforms into a bend or elbow 36 that connects shaft section 30 to shaft section 38. Shaft section 38 has a first end 40 that connects with elbow 36 and terminates with a second end 42.

Shoulder harness assembly 47 has a shoulder cap 48 that is made of a semi-rigid material and is designed to fit the contour of a shoulder of a user. Resilient flexible loop 56 connects canoe paddle shaft section 38 to shoulder cap 48 of shoulder harness assembly 47. Resilient flexible loop 56 is a connecting device and a wide variety of other connecting devices could be utilized to connect shaft handle section 38 to the shoulder harness assembly 47. Shoulder harness assembly 47 includes a first strap assembly 52 that loops under one arm of a user and a second strap assembly 53 that loops under the other arm of a user. Alternate second strap assembly 53A can be utilized if the user does not have a second arm.

Figure 2:
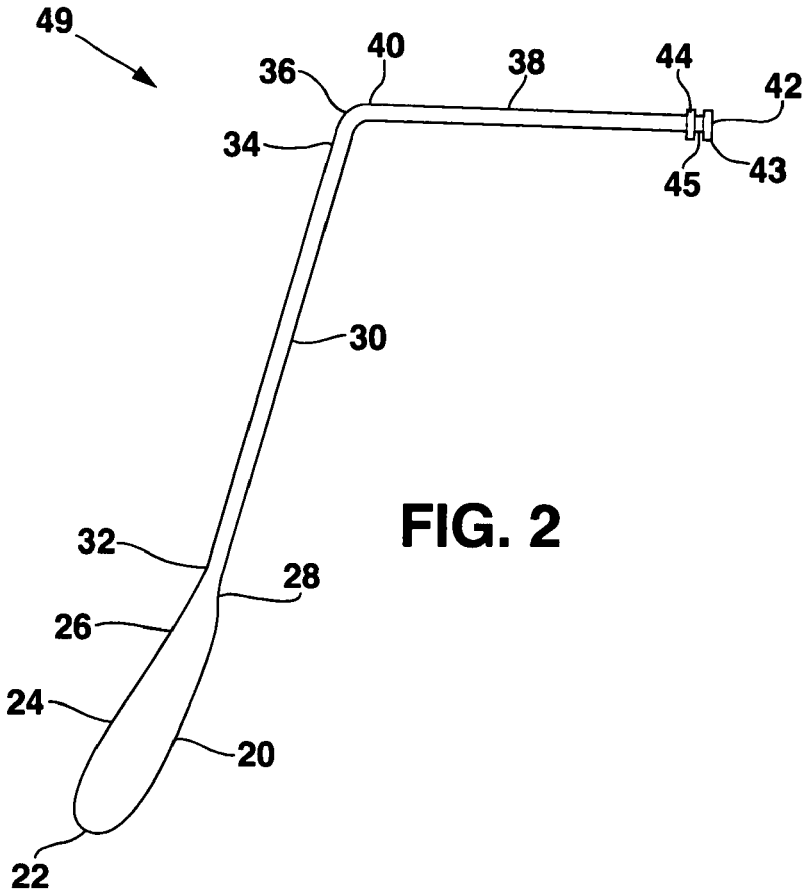
FIG. 2 is a side view of the blade and handle shaft section of the embodiment of the canoe paddle device for one-arm use designed for a right handed user that is shown in FIG. 1.

FIG. 2, shown generally at 49, is a side view of the blade and handle shaft section of the embodiment of the canoe paddle device for one-arm use designed for a right handed user that is shown in FIG. 1. Blade and shaft section has a blade 20 with the contoured tip 22 of the blade and wide section 24 which is approximately 8 inches wide. The blade has a curving section 26 that terminates in substantially a shaft 28. The length of the blade from the blade tip 22 to the shaft is approximately 18 inches and the widest width is approximately 8 inches. Paddle shaft section 30 has a blade end 32 and a non-blade end 34. The length of shaft section 30 is approximately 22 inches long and the length can be custom designed to accommodate any user if so desired. The diameter of the shaft is approximately 1¼ inches, but can be made with various diameters. Paddle shaft section 30 is grasped by a hand of a user and the hand and arm of a user is substantially in a perpendicular orientation to the axis of paddle shaft section 30 during paddle strokes. Paddle shaft end 34 transforms into an elbow 36 that connects shaft section 30 to shaft section 38. The angle of the elbow is approximately 110 degrees. Shaft section 38 has a first end 40 that connects to elbow 36 and terminates with a second end 42. Shaft end 42 can have a cap 43 that forms a raised section. Shaft section 38 also has a raised section 44 near shaft end 42. Shaft raised section 44 and cap raised section 43 has recessed section 45 therebetween that holds resilient flexible loop 56 of the shoulder harness assembly 47. The length of shaft section 38 is approximately 19 inches long and the length can be designed to accommodate any user if so desired. Blade orientation is rotated on the x axis approximately 20 degrees off center of the axis of the paddle shaft. For a right hand user the rotation would be 20 degrees counterclockwise off center of the axis of the handle shaft. For a left hand user the rotation would be 20 degrees clockwise off center of the axis of the handle shaft. This off center rotation of the paddle blade enables the most efficient stroke as the blade would be oriented substantially perpendicular to the keel of the canoe.

When the style of the canoe is such that the shoulder of the paddling arm is situated outside the widest section of the boat, as in outrigger canoe design, the blade orientation can be set at neutral with neither a clockwise nor a counterclockwise rotation.

Paddle blade and shaft is made of carbon fiber. Various other materials such as aluminum, wood, fiberglass, or plastics, etc. could be utilized in various combinations for the blade and shaft components of the canoe paddle device for one-arm use.

Figure 3:
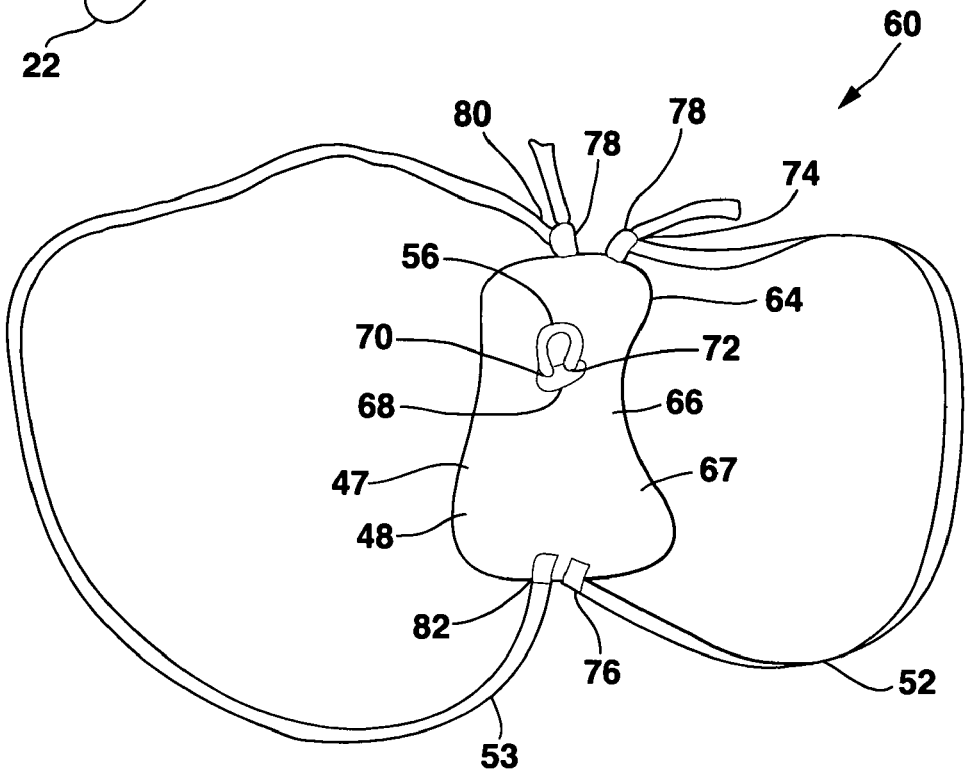
FIG. 3 is perspective view of the shoulder harness assembly of the canoe paddle device for one-arm use shown in FIG. 1.

FIG. 3 shown generally at 60 is a perspective view of the shoulder harness assembly 47 of the canoe paddle device for one-arm use shown in FIG. 1. Shoulder harness assembly 47 has a shoulder cap 48 that is made of a semi-rigid material such as a polyethylene and polypropylene blend, and is designed to fit the contour of a shoulder of a user. Shoulder cap 48 has a front section 64 a middle section 66 and a rear section 67. Shoulder cap 48 has a raised knob 68 that has a first opening 70 and a second opening 72. Resilient flexible loop 56 is formed when ends of stretchable cord are inserted through first opening 70 and second opening 72 of raised knob 68. Stretchable cord ends are knotted together on inside of raised knob 68. Stretchable cord loop 56 tightly fits into slot 45 of paddle shaft end 42 to securely fasten the shaft end 42 to the shoulder harness assembly 47.

Shoulder harness assembly 47 includes a first strap assembly 52 that loops under one arm of a user. First strap assembly 52 has first end 74 that is securely fastened to front section 64 of shoulder cap 48, and a second end 76 that is securely fastened to rear section 67 of shoulder cap 48. First strap assembly 52 includes a buckle 78 that is used to cinch first strap assembly to a tight fit. Buckle 78 has a quick release feature that enables the canoe paddle device for one arm use to be detached quickly if so desired by a user.

Shoulder harness assembly 47 includes a second strap assembly 53 that loops under a second arm of a user. Second strap assembly 53 has first end 80 that is securely fastened to front section 64 of shoulder cap 48 and a second end 82 that is securely fastened to rear section 67 of shoulder cap 48. Buckle 78 has a quick release feature that enables the canoe paddle device for one-arm use to be detached quickly if so desired by a user.

Figure 4:
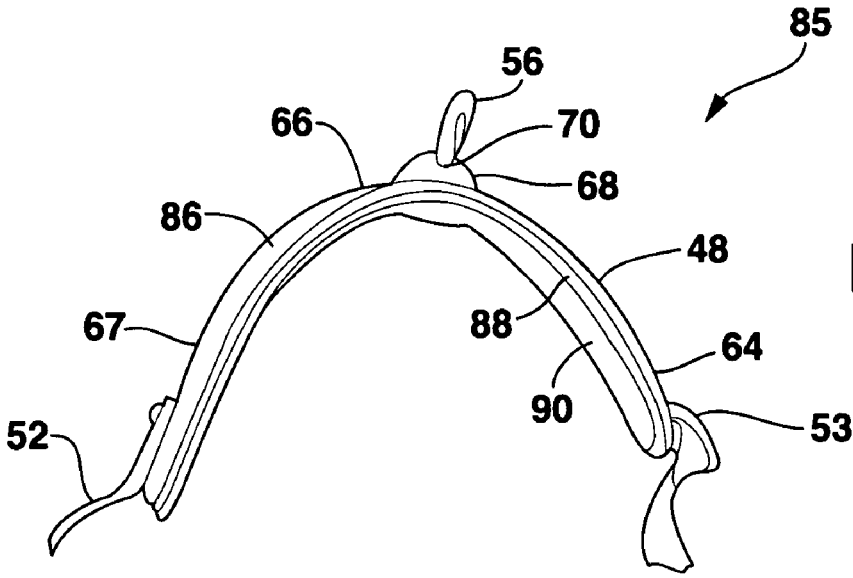
FIG. 4 is a side view of the shoulder harness assembly of the canoe paddle device for one-arm use shown in FIG. 1.

FIG. 4 shows generally at 85 a side view of the shoulder cap 48 of shoulder harness assembly 47 of the canoe paddle device for one-arm use shown in FIG. 1. The top side 86 of shoulder cap 48 is made of a semi-rigid material. The underside 88 of shoulder cap 48 has a cushion material 90 such as PPT attached thereto. The soft lining 90 provides comfort for a user. Shoulder cap 48 has a front section 64 a middle section 66 and a rear section 67. Shoulder cap 48 has a raised knob 68 that has a first opening 70 and a second opening (not shown). Stretchable cord loop 56 is formed when ends of stretchable cord are inserted through first opening 70 and second opening 72 of raised knob 68. Stretchable cord ends are knotted together on inside of raised knob 68.

Stretchable cord loop 56 tightly fits into recess 45 (shown in FIGS. 1 and 2) near shaft end 42 to securely fasten the shaft section 38 to the shoulder cap 48.

Shoulder cap 48 has a first strap assembly 52 that loops under one arm of a user and a second strap assembly 53 that loops under the second arm of a user.

Figure 5:
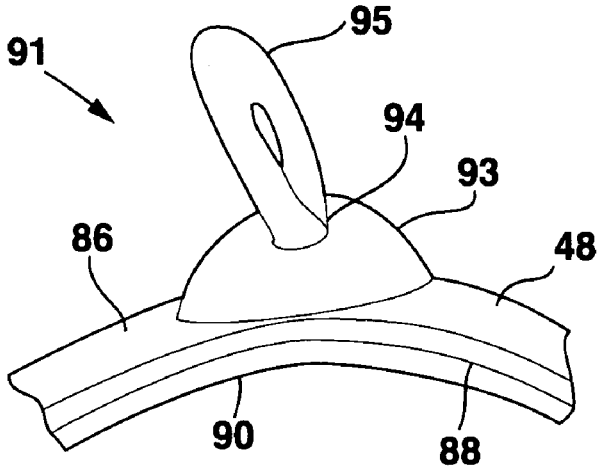
FIG. 5 is a close up side view of the shoulder cap and the flexible fastening loop on the shoulder harness assembly of the canoe paddle device for one-arm use shown in FIG. 1.

FIG. 5, shown generally at 91 is a close up side view of the shoulder cap 48 and a flexible fastening loop 95 on the shoulder cap 48 of the canoe paddle device for one-arm use similar to that shown in FIG. 1. The top side 86 of shoulder cap 48 is made of a semi-rigid material. The underside 88 of shoulder cap 48 has a cushion material 90 such as foam attached thereto. Shoulder cap 48 has a raised knob 93 that has an oval shaped opening 94. Resilient flexible rubber loop 95 extends through opening 94 of raised knob 93. Resilient flexible rubber loop 95 tightly fits into recess 45 near shaft end 42 to securely fasten the shaft-blade section 38 to the shoulder cap 48.

Figure 6:
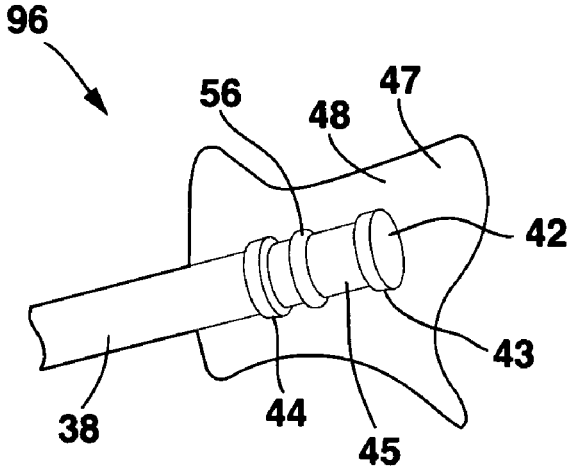
FIG. 6 is a close up perspective view of the shoulder cap and the flexible fastening loop on the shoulder harness assembly of the a canoe paddle device for one-arm use shown in FIG. 1, the flexible loop is shown holding the shaft handle to the shoulder cap.

FIG. 6, shown generally at 96, is a close up perspective view of the shoulder cap 48 and the flexible fastening loop 56 on the shoulder harness assembly 47 of the a canoe paddle device for one-arm use shown in FIG. 1. Flexible loop 56 is shown holding the shaft handle section 38 to the shoulder cap 48. Shaft end 42 has a cap 43 that forms a raised section. Shaft section 38 also has a raised section 44 near shaft end 42. Shaft raised section 44 and cap raised section 43 has recessed section 45 therebetween. Resilient flexible loop 56 connects shaft section 38 to shoulder cap 48.

Figure 7:
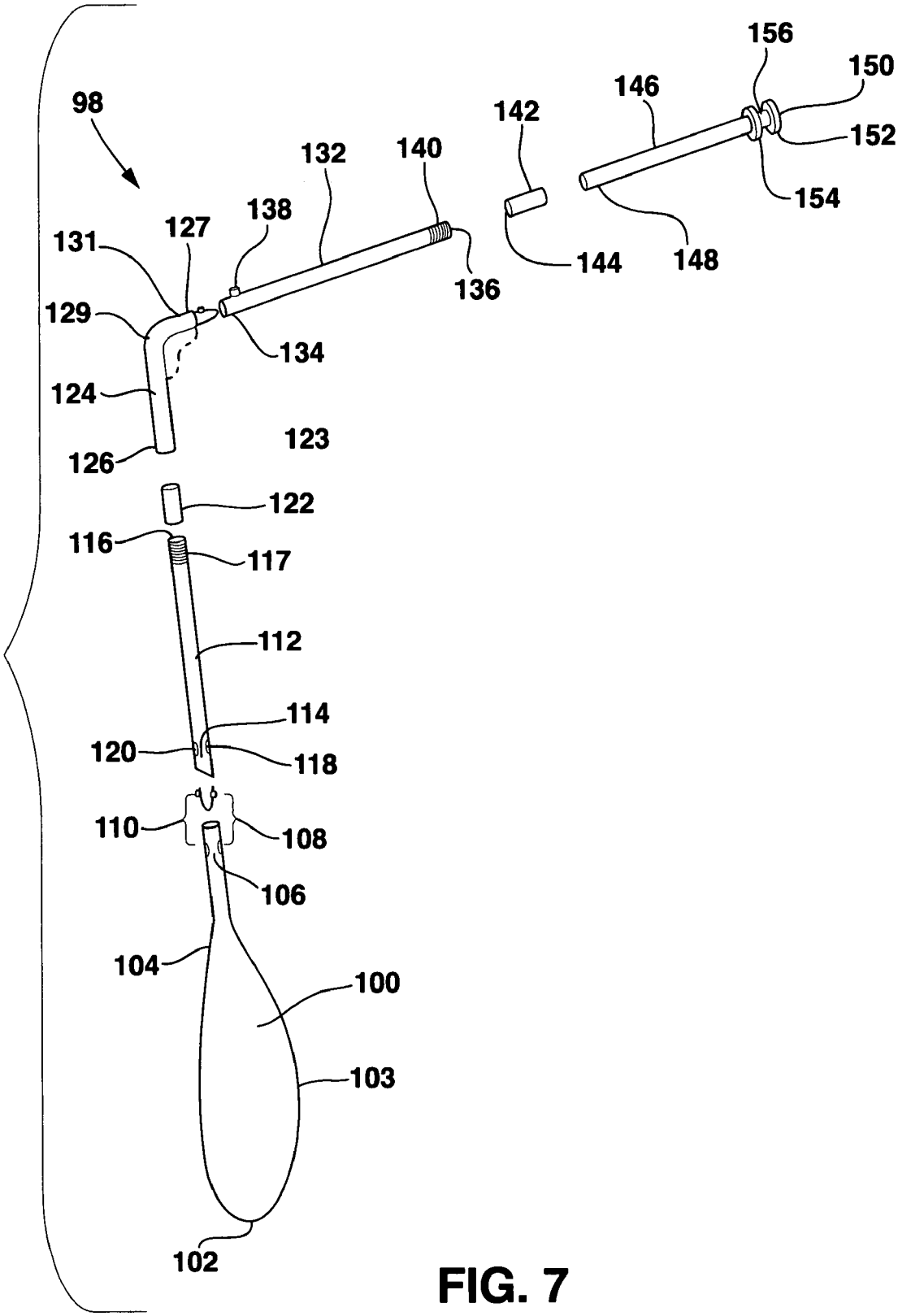
FIG. 7 is a side view of an alternate embodiment of a blade and handle shaft section of the canoe paddle device for one-arm use. This embodiment has several components that can be disassembled and/or adjusted.

FIG. 7, shown generally at 98, is a side view of an alternate embodiment of a blade and handle shaft section a canoe paddle device for one-arm use. This embodiment has several components that can be disassembled and reassembled. Various components can also be adjusted if so desired.

Blade 100 with the contoured tip 102 of the blade and wide section 103 of the blade and a curving section 104 terminates in substantially a tubular shaft 106 end. Tubular shaft end 106 has snap button 108 and snap button 110 that mate with receiving openings 118 and 120 on shaft end 114 of blade section 112. Shaft section 112 has a second end 116 with threads 117. Handle shaft end 114 has a larger diameter than paddle end 106. Paddle end 106 is inserted inside shaft end 114. Receiving openings 118 and 120 mate with snap buttons 108 and 110 to securely fasten blade section 100 to shaft section 112.

Coupling 122 is utilized to make shaft handle lengths adjustable. Coupling 122 has internal threads 123. Shaft elbow section 124 has a first end 126 and a second end 127. When assembled, elbow end 126 of elbow section 124 is inserted through coupling 122 and into open end 116 of shaft section 112. When the desired length is achieved, coupling 122 is tightened onto threads 117 which securely fixes the length. Shaft elbow section 124 has an elbow bend 129 and a receiving opening 131 to receive a locking snap button of the next shaft section.

Shaft section 132 has a first end 134 and a second end 136. Shaft end 134 has a snap button 138 that mates with receiving opening 131 when shaft end 134 is inserted inside open end 127 of shaft elbow section 124. Shaft end 136 terminates with external threads 140.

Coupling 142 is utilized to make the canoe shaft handle length adjustable. Coupling 142 has internal threads 144.

Handle section 146 has a first end 148 and a second end 150. When assembled, shaft end 148 of shaft section 146 is inserted through coupling 142 and into open end 136 of shaft section 132. When the desired length is achieved, coupling 142 is tightened onto threads 140 which securely fixes the length of the canoe paddle shaft.

Shaft end 150 can have a cap 152 that forms a raised section. Shaft section 146 also has a raised section 154 near shaft end 150. Shaft raised section 154 and cap raised section 152 has recessed section 156 therebetween that holds resilient flexible loop 56 of the shoulder harness assembly 47.

Figure 8:
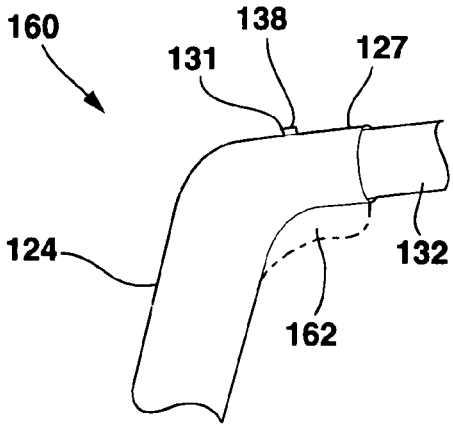
FIG. 8 is a closeup side view of an assembled elbow section of the blade and handle shaft section of the canoe paddle device for one-arm use shown in FIG. 7.

FIG. 8 shows generally at 160, a closeup side view of an assembled elbow section 124 of the blade, and handle shaft section 132 of the canoe paddle device for one-arm use shown in FIG. 7. Shaft end 134 of shaft section 132 fits inside shaft elbow end 127 of shaft elbow section 124. Snap button 138 mates with receiving opening 131 to securely fasten elbow section 124 to shaft section 132. An optional reinforcing rib 162 can make the elbow section 124 stronger.

Figure 9:
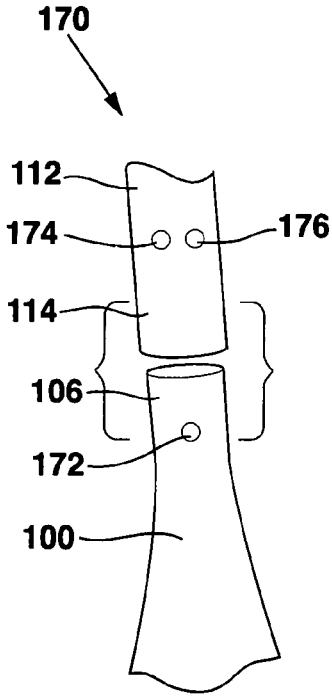
FIG. 9 is a closeup side view of two options for the adjustable blade and handle shaft section of the canoe paddle device for one-arm use shown in FIG. 7. One option the blade is rotated in one direction for a right hand user and the other option the blade is rotated for a left hand user.

FIG. 9 shown generally at 170 is a closeup rear view of the handle shaft showing a blade adjustment feature of the canoe paddle device for one-arm use shown in FIG. 7. Blade end 106 of blade section 100 has snap button 172. When assembled, blade end 106 is inserted inside shaft end 114. If paddle is to be utilized by a left hand user, snap button 172 is inserted into receiving opening 174. If paddle is to be utilized by a right hand user, snap button 172 is inserted into receiving opening 176. The adjustments give the blade a 20 degree offset to the axis of the shaft handle.

Figure 10:
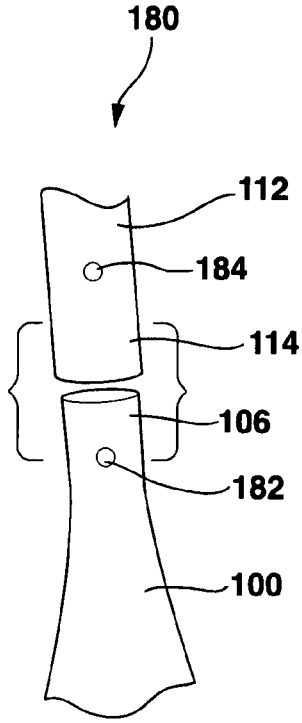
FIG. 10 is a closeup side view of another option of the adjustable blade and handle shaft section of the canoe paddle device for one-arm use shown in FIG. 7. In this option the blade is not rotated, but kept in a neutral orientation to the shaft handle section.

FIG. 10 shown generally 180 at is a closeup front view of the blade shaft section showing another blade adjustment feature of the canoe paddle device for one-arm use shown in FIG. 7. Blade end 106 of blade section 100 has snap button 182. When assembled, blade end 106 is inserted inside shaft end 114. If paddle is to be utilized in a neutral position, snap button 182 is inserted into receiving opening 184.

Figure 11:
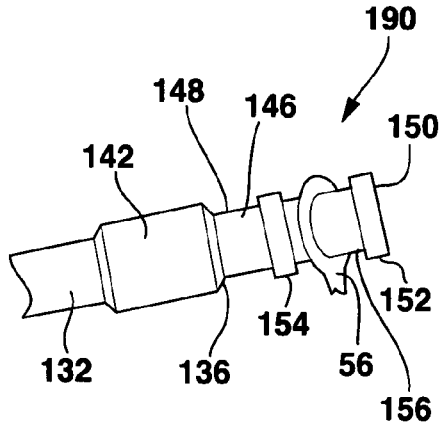
FIG. 11 is a closeup side view of an assembled adjustable length section of the blade and handle shaft section of the canoe paddle device for one-arm use shown in FIG. 7.

FIG. 11 shown generally at 190 is a closeup side view of an assembled adjustable length section of the blade and handle shaft section of the canoe paddle device for one-arm use shown in FIG. 7. Handle section 146 has end 148 inserted through coupling 142 and into open end 136 of shaft section 132. Coupling 142 is tightened onto threads (not shown) which securely fixes the shaft length at the desired length.

Shaft end 150 has a cap 152 that forms a raised section. Shaft section 146 also has a raised section 154 near shaft end 150. Shaft raised section 154 and cap raised section 152 has recessed section 156 therebetween that holds resilient flexible loop 56 of the shoulder harness assembly 47.

Figure 12:
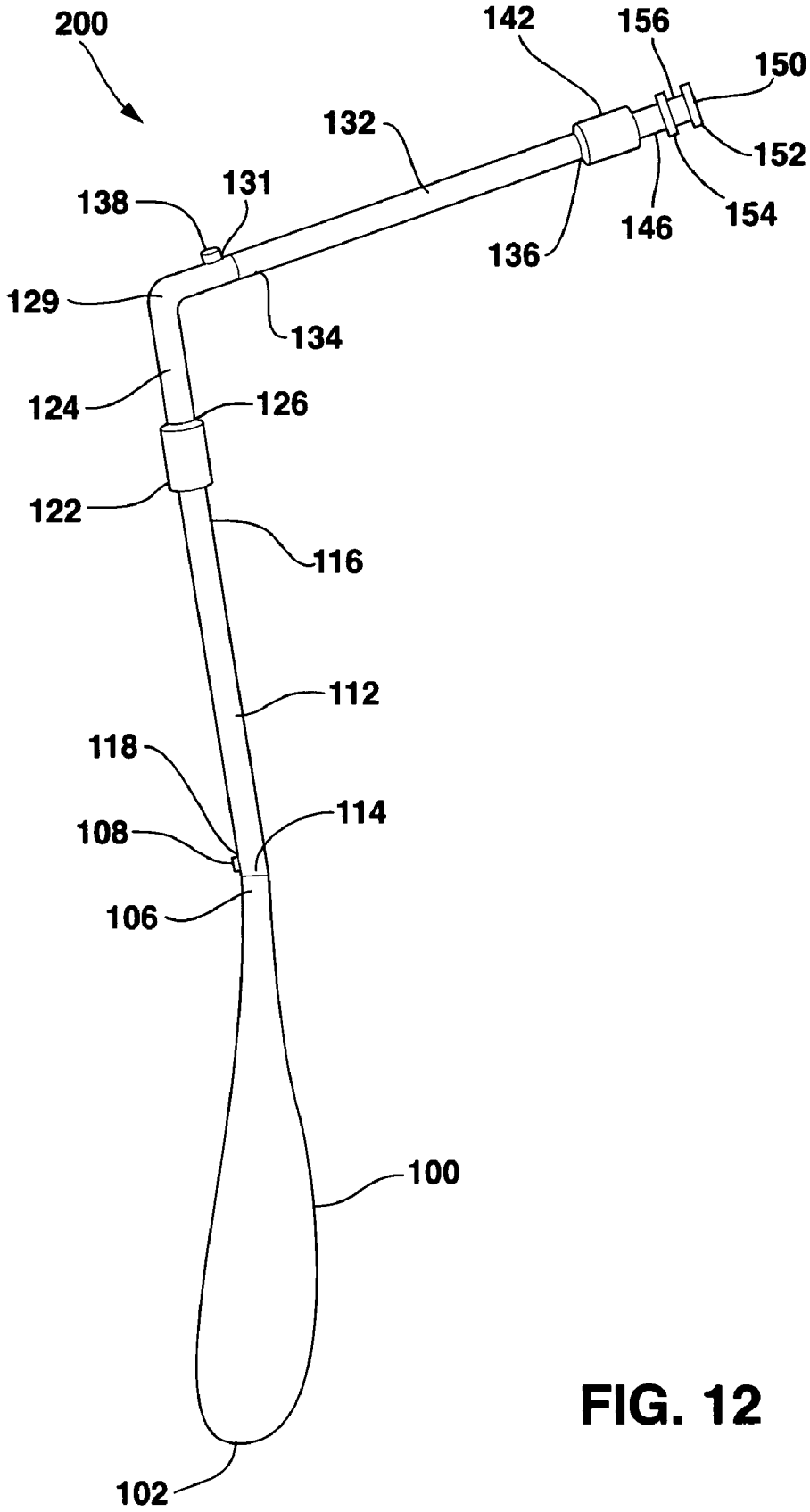
FIG. 12 is a side view of the adjustable blade and handle shaft section of a canoe paddle device for one-arm use shown in FIG. 7. This view has the various components assembled, fastened to desired positions and fastened together.

FIG. 12, shown generally at 200 is a side view of the blade and handle shaft section of the adjustable canoe paddle device for one-arm use shown in FIG. 7. This view has the various components fastened together and the adjustable sections fastened together at the desired lengths and the blade section rotated to the desired position.

To assemble the adjustable canoe paddle device for one-arm use, tubular shaft end 106 of blade section 100 is inserted into tubular shaft end 114 of shaft section 112. Snap button 108 mates with receiving openings 118 to securely fasten blade section 100 to shaft section 112.

Coupling 122 is utilized to make shaft handle lengths adjustable. When assembled, elbow end 126 of elbow section 124 is inserted through coupling 122 and into open end 116 of shaft section 112. When the desired length is achieved, coupling 122 is tightened which securely fixes the length. Shaft elbow section 124 has an elbow bend 129 and an opening 131 to receive a snap button of the next shaft section.

Shaft section 132 has a first end 134 and a second end 136. Shaft end 134 has a snap button 138 that mates with receiving opening 131 when shaft end 134 is inserted inside open end 127 of shaft elbow section 124.

Shaft end 136 terminates with external threads (not shown).

Handle section 146 has a first end 148 (not shown) and a second end 150. When assembled, shaft end 148 of shaft section 146 is inserted through coupling 142 and into open end 136 of shaft section 132. When the desired length is achieved, coupling 142 is tightened onto threads 140 which securely fixes the length of the canoe paddle shaft.

Shaft end 150 can have a cap 152 that forms a raised section. Shaft section 146 also has a raised section 154 near shaft end 150. Shaft raised section 154 and cap raised section 152 has recessed section 156 therebetween that holds resilient flexible loop 56 of the shoulder harness assembly 47.

Figure 13:
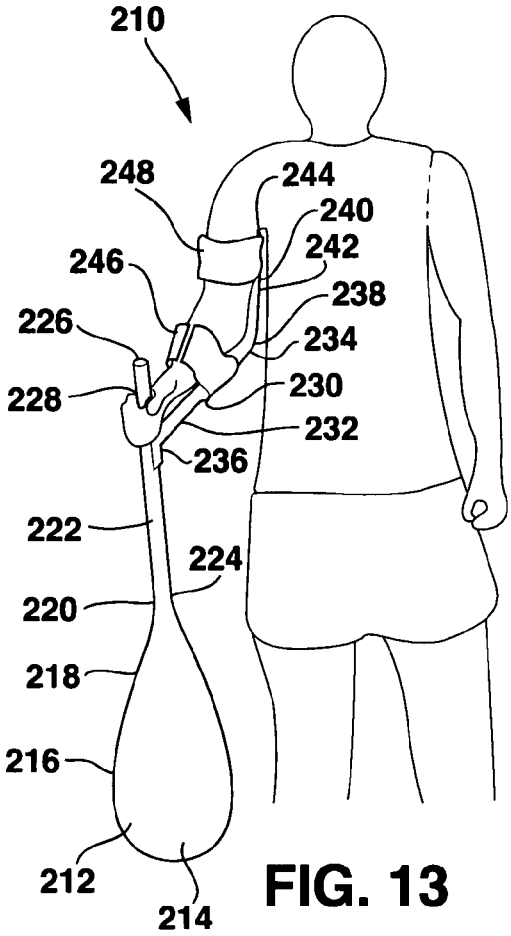
FIG. 13 is a front perspective view of an alternate embodiment of a canoe paddle device for one-arm use designed for a right handed user.

FIG. 13 shown generally at 210 is a front view of an alternate embodiment of a canoe paddle device for one-arm use designed for a right handed user.

Canoe paddle device for one-arm use having a blade 212 with the contoured tip 214 of the blade and wide section 216 of the blade and a curving section 218 that terminates in substantially a shaft 220. Paddle shaft section 222 has a blade end 224 and a non blade end 226. Paddle shaft is grasped by a hand of a user near shaft end 226 at hand grip section 228. Shaft section 230 has a first end 232 and a second end 234. Shaft end 232 is connected to shaft section 222 with a "T" connection 236. Shaft end 234 transforms into an elbow 238. Shaft section 240 has a first end 242 that connects to elbow 238 and a second end 244. Shaft section 230 has a cuff 246 that secures shaft section 230 to the forearm of a one arm user. Cuff 248 is located substantially at the end 244 of shaft section 240. Cuff 248 secures shaft end 244 to the biceps area of a one-arm user.

Figure 14:
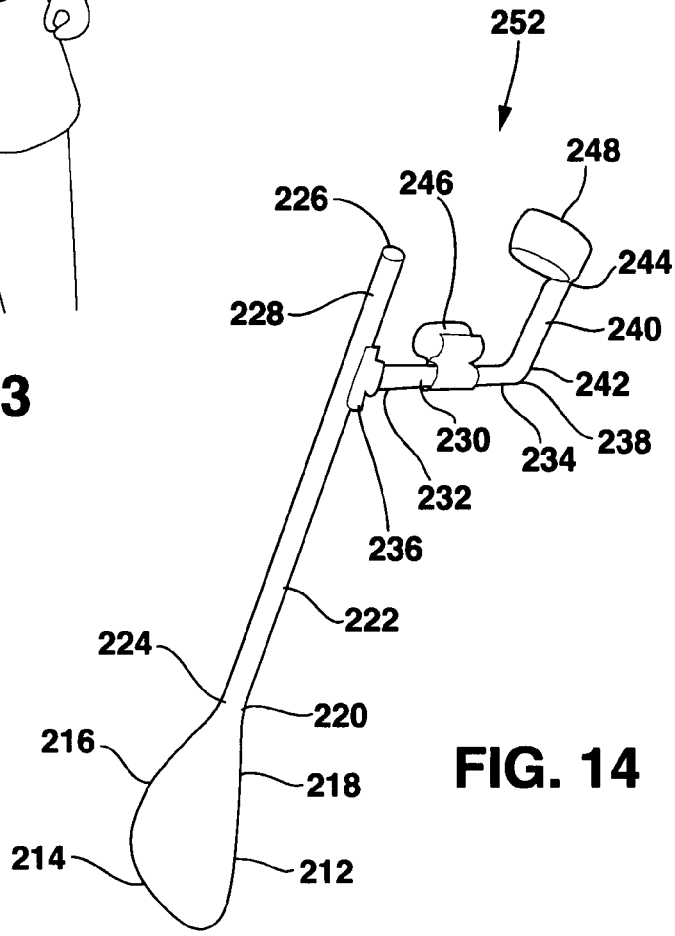
FIG. 14 is a 45 degree side view of the alternate embodiment of a canoe paddle device for one-arm use shown in FIG. 13.

FIG. 14, shown generally at 252, is a side 45 degree view of the alternate embodiment of a canoe paddle device for one-arm use that is shown in FIG. 13.

Canoe paddle device for one-arm use having a blade 212 with the contoured tip 214 of the blade and wide section 216 of the blade and a curving section 218 that terminates in substantially a shaft 220. Paddle shaft section 222 has a blade end 224 and a non blade end 226. Paddle shaft is grasped by a hand of a user near shaft end 226 at hand grip section 228. Shaft section 230 has a first end 232 and a second end 234. Shaft end 232 is connected to shaft section 222 with a "T" connection 236. Shaft end 234 transforms into an elbow 238. Shaft section 240 has a first end 242 that connects to elbow 238 and a second end 244. Shaft section 230 has a cuff 246 that secures shaft section 230 to the forearm of a one-arm user. Cuff 248 is located substantially at the end 244 of shaft section 240. Cuff 248 secures shaft end 244 to the biceps area of a one arm user.

It should be very clear from the drawings and the above description that this new canoe paddle device for one arm use is unique and clearly provides a solution that the prior art does not provide.

This invention having been described in its presently contemplated best mode, it is clear that it is susceptible to numerous, variations, modifications, modes and embodiments within the ability of those skilled in the art and without departing from the true spirit and scope of the novel concepts or principles of this invention. Also, it is to be understood that the phraseology and terminology employed herein are for the purpose of description and should not be regarded as limiting. It should be understood that the preferred embodiments have been shown and described and that all changes and modifications that come within the spirit of the invention are desired to be protected. The invention is capable of other embodiments and of being practiced and carried out in various ways. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Accordingly, the scope of the invention is defined by the scope of the following claims.

What is claimed as new and desired to be secured by United States Letters Patent is:

1. A paddle apparatus suitable for propelling a water craft by a person with one arm; said paddle apparatus comprising:

a mounting harness and a paddle;

said mounting harness having a shoulder cap; said shoulder cap having a shoulder cap top portion, a shoulder cap front portion and a shoulder cap rear portion; said shoulder cap top portion designed to fit the contour of the top of a human shoulder; said shoulder cap front portion extending toward the chest of a user; and said shoulder cap rear portion extending toward the back of a user; said shoulder cap having an inner surface and an outer surface;

said shoulder cap top portion having a raised section that forms a shoulder cap raised knob; said shoulder cap raised knob having a raised knob first opening therethrough and raised knob second opening therethrough;

a resilient flexible cord that is inserted through said raised knob first opening, and inserted through said raised knob second opening; said resilient flexible cord forming a resilient flexible loop on the outside of said raised knob;

said mounting harness having a strap that is connected to said shoulder cap, and a buckle that is connected to said strap;

said paddle having a blade and a handle; said handle having a fastening end;

said resilient flexible loop encircling said fastening end of said paddle.

2. The paddle apparatus of claim 1 wherein said paddle handle has a bend thereon.

3. The paddle apparatus of claim 1 wherein said paddle handle has a bend thereon, said bend having an angle that is substantially 110 degrees.

4. The paddle apparatus of claim 1 wherein the length of said paddle handle is adjustable.

5. The paddle apparatus of claim 1 wherein the rotation of said blade is adjustable.

6. The paddle apparatus of claim 1 wherein said paddle made of wood, or carbon fiber, or fiberglass, or aluminum, or plastic, or any combination thereof.

7. The paddle apparatus of claim 1 wherein said shoulder cap made of a semi-rigid material.

8. The paddle apparatus of claim 1 wherein said shoulder cap made of a polyethylene and polypropylene blend plastic material.

9. The paddle apparatus of claim 1 wherein said inner surface of said shoulder cap has a cushion material thereon.

10. The paddle apparatus of claim 1 wherein said buckle has quick release means incorporated thereon.

11. The paddle apparatus of claim 1 including a second strap that is fastened to said shoulder cap.

12. The paddle apparatus of claim 1 wherein said resilient flexible cord has ends that are fastened together on the inside of said shoulder cap raised knob.

13. The paddle apparatus of claim 1 wherein said resilient flexible cord has ends that are knotted together on the inside of said shoulder cap raised knob.

14. The paddle apparatus of claim 1 wherein said handle fastening end has a recess, and said resilient flexible loop is securely fastened within said recess.

15. A paddle apparatus suitable for propelling a water craft by a person with one arm; said paddle apparatus comprising:

a mounting harness and a paddle;

said mounting harness having a shoulder cap; said shoulder cap having a shoulder cap top portion, a shoulder cap front portion and a shoulder cap rear portion; said shoulder cap top portion designed to fit the contour of the top of a human shoulder; said shoulder cap front portion extending toward the chest of a user; and said shoulder cap rear portion extending toward the back of a user; said shoulder cap having an inner surface and an outer surface;

said shoulder cap top portion having a raised section that forms a shoulder cap raised knob; said shoulder cap raised knob having a raised knob first opening therethrough and raised knob second opening therethrough;

a resilient flexible cord that is inserted through said raised knob first opening, and inserted through said raised knob second opening; said resilient flexible cord forming a resilient flexible loop on the outside of said raised knob;

said mounting harness having a strap that is connected to said shoulder cap, and a buckle that is connected to said strap;

said paddle having a blade and a handle; said handle having a bend thereon; said handle having a fastening end;

said resilient flexible loop encircling said fastening end of said paddle.

16. The paddle apparatus of claim 15 wherein, said bend on said handle has an angle that is substantially 110 degrees.

17. The paddle apparatus of claim 15 wherein said buckle has quick release means incorporated thereon.

18. The paddle apparatus of claim 15 wherein the length of said paddle handle is adjustable.

19. The paddle apparatus of claim 15 wherein the rotation of said blade is adjustable.

20. A paddle apparatus suitable for propelling a water craft by a person with one arm; said paddle apparatus comprising:

a mounting harness and a paddle;

said mounting harness having a shoulder cap; said shoulder cap having a shoulder cap top portion, a shoulder cap front portion and a shoulder cap rear portion; said shoulder cap top portion designed to fit the contour of the top of a human shoulder; said shoulder cap front portion extending toward the chest of a user; and said shoulder cap rear portion extending toward the back of a user; said shoulder cap having an inner surface and an outer surface;

said shoulder cap top portion having a raised section that forms a shoulder cap raised knob; said shoulder cap raised knob having a resilient flexible loop on the outside of said raised knob;

said mounting harness having a strap that is connected to said shoulder cap, and a buckle that is connected to said strap; said buckle having a quick release means;

said paddle having a blade and a handle; said handle having a bend thereon; said handle having a fastening end;

said resilient flexible loop encircling said fastening end of said paddle.

* * * * *